US008134584B2

(12) United States Patent
Choi et al.

(10) Patent No.: US 8,134,584 B2
(45) Date of Patent: Mar. 13, 2012

(54) IMAGE FORMING APPARATUS AND METHOD OF CORRECTING COLOR REGISTRATION

(75) Inventors: Jong-Chul Choi, Suwon-si (KR); Jun-O Kim, Yongin-si (KR); Jin-Ho Lee, Suwon-si (KR); Hee-Moon Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 145 days.

(21) Appl. No.: 12/558,006

(22) Filed: Sep. 11, 2009

(65) Prior Publication Data

US 2010/0104330 A1 Apr. 29, 2010

(30) Foreign Application Priority Data

Oct. 27, 2008 (KR) ..... 10-2008-0105486

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/228, 347/229, 231, 234, 243, 248–250, 259, 260, 347/116, 235; 399/301
See application file for complete search history.

(56) References Cited

U.S. PATENT DOCUMENTS 7,423,799 B2 * 9/2008 Dewa ..... 359/291
7,495,813 B2 * 2/2009 Akiyama et al. ..... 359/204.1
7,697,180 B2 * 4/2010 Nakajima ..... 359/199.1

* cited by examiner

*Primary Examiner* — Hai C Pham
(74) *Attorney, Agent, or Firm* — Staas & Halsey LLP

(57) ABSTRACT

Disclosed are an image forming apparatus capable of, and method of, improving color registration. The image forming apparatus can employ a beam deflector having a double-sided mirror portion that pivots to bi-directionally scan multiple light beams on multiple photosensitive media at different phases by using both mirror sides of the double-sided mirror portion. The individual monochromic images developed on the photosensitive media are transferred onto a transfer medium to overlap one another in phase to form a full color image.

23 Claims, 11 Drawing Sheets

IMAGE FORMING APPARATUS AND METHOD OF CORRECTING COLOR REGISTRATION

CROSS-REFERENCE TO RELATED PATENT APPLICATIONS

This application claims the benefit of Korean Patent Application No. 10-2008-0105486, filed on Oct. 27, 2008, in the Korean Intellectual Property Office, the disclosure of which is incorporated herein by reference in its entirety.

TECHNICAL FIELD

The present disclosure relates generally to an image forming apparatus and a method of improving color registration.

BACKGROUND OF RELATED ART

Electro-photographic image forming apparatuses generally operate to form an electrostatic latent image by scanning light beams on the surface of a drum using a light scanning unit, develop the electrostatic latent image using a developing agent (e.g., toner) to generate a developed image, transfer the developed image onto a printing medium, and fuse the transferred image to the printing medium to form an image.

The light scanning unit of a conventional image forming apparatus typically uses a polygon mirror driven with, e.g., a spindle motor. A new mechanism to replace the spindle motor and the polygon mirror may be needed to overcome limitations in the velocity of the polygon mirror, to remove noise generated by the spindle motor during a high velocity operation, and/or to reduce the size of the light scanning unit. The light scanning unit can use a micro electro-mechanical system (MEMS) structure that allows for bidirectional and high-velocity scanning. Moreover, the light scanning unit can be made using semiconductor processes such that it has a very small size. Thus, the light scanning unit can be made using a MEMS structure instead of a polygon mirror. Because a light scanning unit scans multiple light beams to form a color image, using a MEMS-type beam deflector can be advantageous in that the MEMS-type beam deflector can rotate and vibrate a double-sided mirror and can scan multiple light beams concurrently.

SUMMARY OF THE DISCLOSURE

According to an aspect of the present disclosure, there is provided an image forming apparatus that may include one or more light sources, a beam deflector, a first photosensitive member and a second photosensitive member. The one or more light sources may be configured to emit at least a first light beam and a second light beam. The beam deflector may include a double mirror portion having a first mirror and a second mirror that are not coplanar with respect to each other. The double mirror portion may be configured to pivot about a pivotal axis that extends substantially parallel to the surfaces of the first and second mirrors such that respective light beams deflected by the first mirror and the second mirror are out of phase with respect to each other by a deflected phase difference. The first photosensitive member may be configured to receive the first light beam reflected by the first mirror of the beam deflector. The second photosensitive member may be configured to receive the second light beam reflected by the second mirror of the beam deflector. The first light beam and the second light beam may have a timing difference therebetween such that the first and second light beams are substantially in phase when respectively received by the first and second photosensitive members.

The first and second mirrors may be arranged on opposite sides of the double mirror portion such that the deflected phase difference is 180 degrees. The timing difference may be an odd multiple of half a pivot period of the beam deflector during which the double mirror portion completes a pivot within a range of its pivoting motion.

The image forming apparatus may further comprise a pre-scan optical system disposed along the optical path defined between the one or more light sources and the beam deflector.

The pre-scan optical system may include a first lens and a second lens. The first lens may be configured to collimate light beams received from the one or more light sources. The second lens may have a cylindrical shape, and may be configured to receive the collimated light beams from the first lens.

The double mirror portion of the beam deflector may be constructed as a micro electro-mechanical (MEMS) structure configured to vibrate in a sinusoidal manner.

The double mirror portion may include a plurality of first mirrors arranged on a first side of the beam deflector and a plurality of second mirrors arranged on a second side of the beam deflector opposite the first side. The first light beam may comprise a first group of light beams that includes a first plurality of light beams. The second light beam may comprise a second group of light beams that includes a second plurality of light beams. The first plurality of light beams may be incident on the corresponding ones of the plurality of first mirrors substantially parallel to one another. The second plurality of light beams may be incident on the corresponding ones of the plurality of second mirrors substantially parallel to one another.

Alternatively, the plurality of first mirrors may be configured to receive light beams from the first group of light beams at different angles of incidence. The plurality of second mirrors may also be configured to receive light beams from the second group of light beams at different angles of incidence.

The image forming apparatus may further comprise a post-scan optical system configured to image the first light beam on the first photosensitive member and to image the second light beam on the second photosensitive of member.

The double mirror portion of the beam deflector may be configured to vibrate in a sinusoidal manner. The post-scan optical system may be configured to apply an arcsine-like function so as to compensate for the sinusoidal manner vibration of the double mirror portion so that the first and second light beams are each imaged at a substantially uniform velocity.

The image forming apparatus may further comprise a transfer member configured to receive a first image from the first photosensitive member and a second image from the second photosensitive member such that the received second image overlaps with the received first image. The distance between the first photosensitive member and the second photosensitive member along a sub-scanning direction of the image forming apparatus may correspond to an odd multiple of half of a distance the transfer member travels during the pivot period of the beam deflector.

The first light beam and the second light beam may be spaced apart along a sub-scanning direction by a distance substantially same as the distance between the first photosensitive member and the second photosensitive member.

According to an embodiment, the first light beam may comprise a first group of light beams that includes the first light beam and a third light beam. The second light beam may comprise a second group of light beams that includes the second light beam and a fourth light beam. The first group of light beams may be modulated with information corresponding to a first group of monochromic images. The second group of light beams may be modulated with information corresponding to a second group of monochromic images different from the first group of monochromic images.

The first group of monochromic images may include two images from among yellow (Y), magenta (M), cyan (C) and black (K) images. The second group of monochromic images may include the remaining two images from among yellow (Y), magenta (M) cyan (C) and black (K) images.

The first light beam may comprise a first group of light beams that includes a first plurality of light beams. The second light beam may comprise a second group of light beams that includes a second plurality of light beams. the first mirror comprises a first group of one or more mirrors coplanar with respect to each other so as to reflect light beams in phase with respect to each other, the second mirror comprising s second group of one or more mirrors coplanar with respect to each other so as to reflect light beams in phase with respect to each other, the first and second groups of mirrors not being coplanar with respect to each other such that light beams deflected by the first group of one or more mirrors are out of phase with light beams deflected by the second group of one or more mirrors by the deflected phase difference. the first photosensitive member may comprise a first group of photosensitive members that includes a first plurality of photosensitive members each configured to receive a respective corresponding one of the first plurality of light beams from the first group of one or more mirrors. The second photosensitive member may comprise a second group of photosensitive members that includes a second plurality of photosensitive members each configured to receive a respective corresponding one of the second plurality of light beams from the second group of one or more mirrors. The first and second plurality of photosensitive members being arranged to satisfy relationships defined by: $D1=D3\pm DP\cdot(m-1)$; and $D2=D1\pm(DP/2)\cdot(2n-1)$. D1 may correspond to a first distance by which two adjacent ones of the first plurality of photosensitive members are spaced apart from each other along the sub-scanning direction. D2 may correspond to a second distance between any one of the first plurality of photosensitive members and any one of the second plurality of photosensitive members adjacent to each other along the sub-scanning direction. D3 may correspond to a third distance by which two adjacent ones of the second plurality of photosensitive members are spaced apart from each other along the sub-scanning direction. DP may correspond to the distance the transfer member travels during the pivot period of the beam deflector. The indices, n and m, each being a positive integer greater than zero.

The first group of photosensitive members may be disposed downstream of the second group of photosensitive members with respect to the direction of travel of the transfer medium along the sub-scanning direction. The distance D2 may be larger than the distance D1 by $(DP/2)\cdot(2n-1)$. The timing of the first group of light beams may be delayed by $(P/2)\cdot(2n-1)$ with respect to the second group of light beams, where P corresponds to the pivot period of the beam deflector.

Alternatively, the distance D2 may be smaller than the distance D1 by $(DP/2)\cdot(2n-1)$, in which case the timing of the second group of light beams may be delayed by $(P/2)\cdot(2n-1)$ with respect to the first group of light beams.

The relative positions of each of the first and second plurality of light beams incident on a respective corresponding one of the first and second plurality of photosensitive members may satisfy the relationships defined by: $D1'=D3'\pm D\cdot(m-1)$; and $D2'=D1'\pm(D/2)\cdot(2n-1)$. D1' may correspond to a fourth distance by which two adjacent ones of the first plurality of light beams are spaced apart from each other along the sub-scanning direction. D2' may correspond to a fifth distance between any one of the first plurality of light beams and any one of the second plurality of light beams adjacent to each other along the sub-scanning direction. D3' may correspond to a sixth distance by which two adjacent ones of the second plurality of light beams are spaced apart from each other along the sub-scanning direction. D may correspond to the distance the transfer member travels during the pivot period of the beam deflector.

The image forming apparatus may further comprise a transfer member configured to receive a first image from the first photosensitive member and a second image from the second photosensitive member such that the received second image overlaps with the received first image. The transfer medium may have one of a belt shape and a drum shape.

According to another aspect of the present disclosure, a method of forming a color image may include the steps of: scanning a first group of light beams associated with a first group of monochromic images on a first group of photosensitive members by deflecting the first group of light beams with a beam deflector toward the first group of photosensitive members, the beam deflector including a double mirror portion having a first group of one or more mirrors coplanar with respect to each other and a second group of one or more mirrors that are not coplanar with the first group of one or more mirrors, the double mirror portion being configured to pivot about a pivotal axis that extends substantially parallel to the surfaces of the first and second groups of one or more mirrors such that respective light beams deflected by the first group of one or more mirrors and the second group of one or more mirrors are out of phase with respect to each other by a deflected phase difference, the first group of light beams being deflected off the first group of one or more mirrors of the beam deflector to form a first group of latent images on the first group of photosensitive members; scanning a second group of light beams associated with a second group of monochromic images on a second group of photosensitive members by deflecting the second group of light beams off the second group of one or more mirrors of the beam deflector toward the second group of photosensitive members to form a second group of latent images on the second group of photosensitive members, the second group of latent images being substantially in phase with the first group of latent images; developing the first group of latent images by applying thereto a first group of monochromic colored toner to form a first group of monochromatic toner images on the first group of photosensitive members; developing the second group of latent images by applying thereto a second group of monochromic colored toner to form a second group of monochromatic toner images on the second group of photosensitive members; and transferring the first group of monochromic toner images and the second group of monochromic toner images onto a transfer medium in phase to overlap one another to form the color image on the transfer medium.

The first and second mirrors may be arranged on opposite sides of the double mirror portion such that the deflected phase difference is 180 degrees. The step of scanning the second group of light beams may comprise scanning each of the second group of light beams with a timing difference with respect to each of the first group of light beams. The timing difference may be an odd multiple of half a pivot period of the beam deflector during which the double mirror portion completes a pivot within a range of its pivoting motion.

The method may further comprise positioning the first group of light beams and the second group of light beams such that any one of the first group of light beams being spaced apart from any one of the second group of light beams along a sub-scanning direction by a distance based on a time interval corresponding to an odd multiple of half of the pivot period of the beam deflector and on a travel velocity of the transfer medium.

The color image may be formed by overlapping four different monochromic toner images.

The first group of monochromic toner images may include two images from among yellow (Y), magenta (M), cyan (C) and black (K) images. The second group of monochromic toner images may include the remaining two images from among yellow (Y), magenta (M), cyan (C) and black (K) images.

According to yet another aspect of the present disclosure, a color image forming apparatus may be provided to include a plurality of photosensitive members, a beam deflector and a transfer member. The beam deflector may be configured to scan light beams on the plurality of photosensitive members to thereby form thereon electrostatic latent images. The beam deflector may include a double mirror portion having a first mirror and a second mirror, respective surfaces of which are not coplanar. The double mirror portion may be configured to pivot about a pivotal axis that extends substantially parallel to the surfaces of the first and second mirrors such that respective light beams deflected by the first mirror and the second mirror are out of phase with respect to each other by a deflected phase difference. The transfer member may be configured to receive from the plurality of photosensitive members a plurality of monochromatic images to overlap one another to thereby form a color image. a first two adjacent ones of the plurality of photosensitive members may be spaced apart from each other along a sub-scanning direction of the color image forming apparatus by a first distance. A second two adjacent ones of the plurality of photosensitive members may be spaced apart from each other along the sub-scanning direction by a second distance different from the first distance.

The first and second mirrors may be arranged on opposite sides of the double mirror portion such that the deflected phase difference is 180 degrees. The difference between the first distance and the second distance may satisfy $(DP/2)\cdot(2n-1)$. DP may correspond to the distance the transfer member travels during a pivot period of the beam deflector during which the double mirror portion completes a pivot within a range of its pivoting motion. The index n being a positive integer greater than zero.

BRIEF DESCRIPTION OF THE DRAWINGS

Various features and advantages of the present disclosure will become more apparent by the following description of several embodiments thereof with reference to the attached drawings, in which.

DETAILED DESCRIPTION OF SEVERAL EMBODIMENTS

Figure 1:
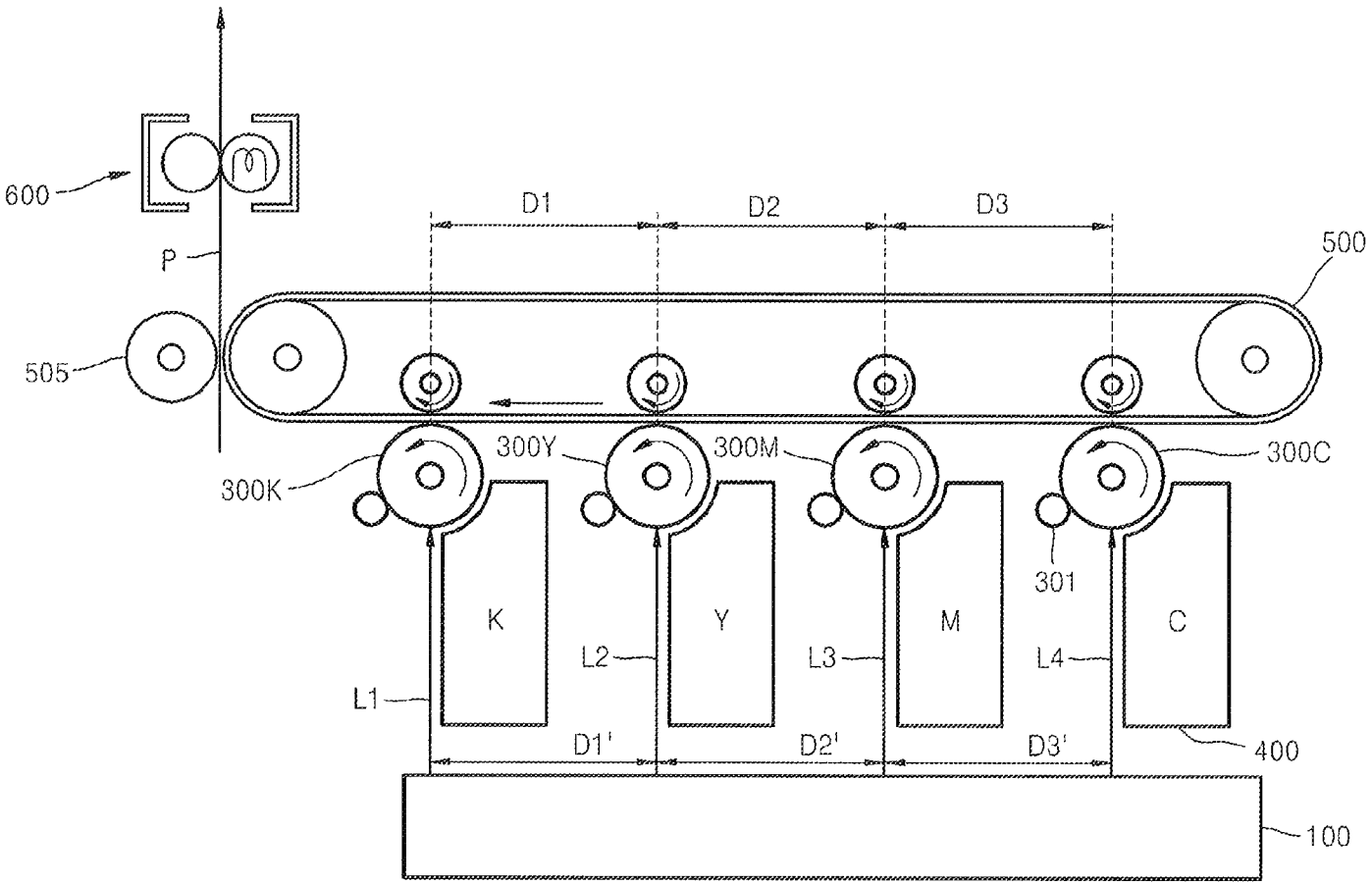
FIG. 1 illustrates a structure of an image forming apparatus according to an embodiment of the present disclosure.

The present disclosure is more fully described below with reference to the accompanying drawings, in which several embodiments of the disclosure are shown. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should also be noted that in the drawings, the dimensions of the features are not intended to be to true scale and may be exaggerated for the sake of allowing greater understanding.

FIG. 1 illustrates an image forming apparatus capable of performing a correction of color registration according to an embodiment of the present disclosure. Referring to FIG. 1, the apparatus may include a light scanning unit 100, a first photosensitive drum 300K, a second photosensitive drum 300Y, a third photosensitive drum 300M, a fourth photosensitive drum 300C, multiple developing units 400, an intermediate transfer belt 500 and a fusing unit 600.

The light scanning unit 100 can be configured to scan a first light beam L1, a second light beam L2, a third light beam L3 and a fourth light beam L4 on the first through fourth photosensitive drums 300K, 300Y, 300M and 300C, respectively. Each of the light beams can be modulated according to image information. In the current embodiment, four different colors can be used to form a color image. The light scanning unit 100 can scan the first through fourth light beams L1, L2, L3 and L4 based on black (K), yellow (Y), magenta (M), and cyan (C) image information, respectively.

The light scanning unit 100 can be configured to scan the first through fourth light beams L1, L2, L3 and L4 by deflecting the light beams using a double-sided mirror as further described below. Thus, a phase at which the first and second light beams L1 and L2 are scanned can be different from a phase at which the third and fourth light beams L3 and L4 are scanned. As described below, when a phase difference occurs during the scanning of the first through fourth light beams L1, L2, L3 and L4, a color registration error can result. Thus, exposure starting times for the first through fourth light beams, L1, L2, L3 and L4, and the distances D1', D2' and D3' in the sub-scanning direction at which the first through fourth light beams L1, L2, L3 and L4 are scanned may need to be properly designed to correct color registration errors that may occur. The exposure starting times of the first through fourth light beams L1, L2, L3 and L4 and the distances D1', D2' and D3' are described below.

The first through fourth photosensitive drums 300K, 300Y, 300M and 300C are examples of photosensitive media made by forming photosensitive layers having a predetermined thickness on an outer circumferential surface of a cylindrical metal pipe. The outer circumferential surfaces of the first through fourth photosensitive drums 300K, 300Y, 300M and 300C are the surfaces on which the first through fourth light beams L1, L2, L3 and L4 scanned by the light scanning unit 100 can be imaged. In an alternative embodiment, a belt-shaped photosensitive member may alternatively be used as the photosensitive medium, for example. Reference numeral 301 in FIG. 1 denotes a charging roller. The charging roller 301 is an example of a charging device configured to charge the surface of the first through fourth photosensitive drums 300K, 300Y, 300M and 300C to a uniform electrical potential while rotating in contact with the first through fourth photosensitive drums 300K, 300Y, 300M and 300C. The developing units 400 may be disposed at each of the first through fourth photosensitive drums 300K, 300Y, 300M and 300C. Each developing unit 400 can be configured to accommodate one of black (K), yellow (Y), magenta (M) and cyan (C) toners therein. After electrostatic latent images are formed via the light scanning unit 100 on the first through fourth photosensitive drums 300K, 300Y, 300M and 300C, the electrostatic latent images can be developed by the developing units 400 so that visible black (K), yellow (Y), magenta (M) and cyan (C) images are formed.

The intermediate transfer belt 500 is an example of a transfer medium configured to transfer different color images formed on the first through fourth photosensitive drums 300K, 300Y, 300M and 300C onto a printing medium P (e.g., paper). A drum type transfer medium can also be used as the transfer medium, for example. Alternatively, in some embodiments, it is possible to transfer the color toner image from the photosensitive drums directly to the printing medium that is routed to travel past each of the photosensitive drums. The intermediate transfer belt 500 can travel along a track at a predetermined velocity, and the toner images formed on the first through fourth photosensitive drums 300K, 300Y, 300M and 300C can be transferred onto the intermediate transfer belt 500. The intermediate transfer belt 500 can then transfer the toner images onto the printing medium P. Reference numeral 505 in FIG. 1 denotes a transfer roller. The toner images can be transferred onto the printing medium P when the printing medium P is conveyed between the transfer roller 505 and the intermediate transfer belt 500 assisted by a transfer bias voltage is applied to the transfer roller 505. The toner images transferred onto the paper P can be fused by the fusing unit 600 to the paper P by heat and pressure applied thereto to complete the image forming operation.

The different individual color images formed on the first through fourth photosensitive drums 300K, 300Y, 300M and 300C can be transferred so as to overlap one another on a portion of the intermediate transfer belt 500 to form a full color image. FIG. 1 shows a structure in which monochromic cyan (C), magenta (M), yellow (Y) and black (K) images can be transferred in that order onto the intermediate transfer belt 500. Distances D1, D2 and D3 at which the first through fourth photosensitive drums 300K, 300Y, 300M and 300C are disposed in the sub-scanning direction can be adjusted to correct a color registration error. Detailed displacement of the first through fourth photosensitive drums 300K, 300Y, 300M and 300C is described below.

Figure 2:
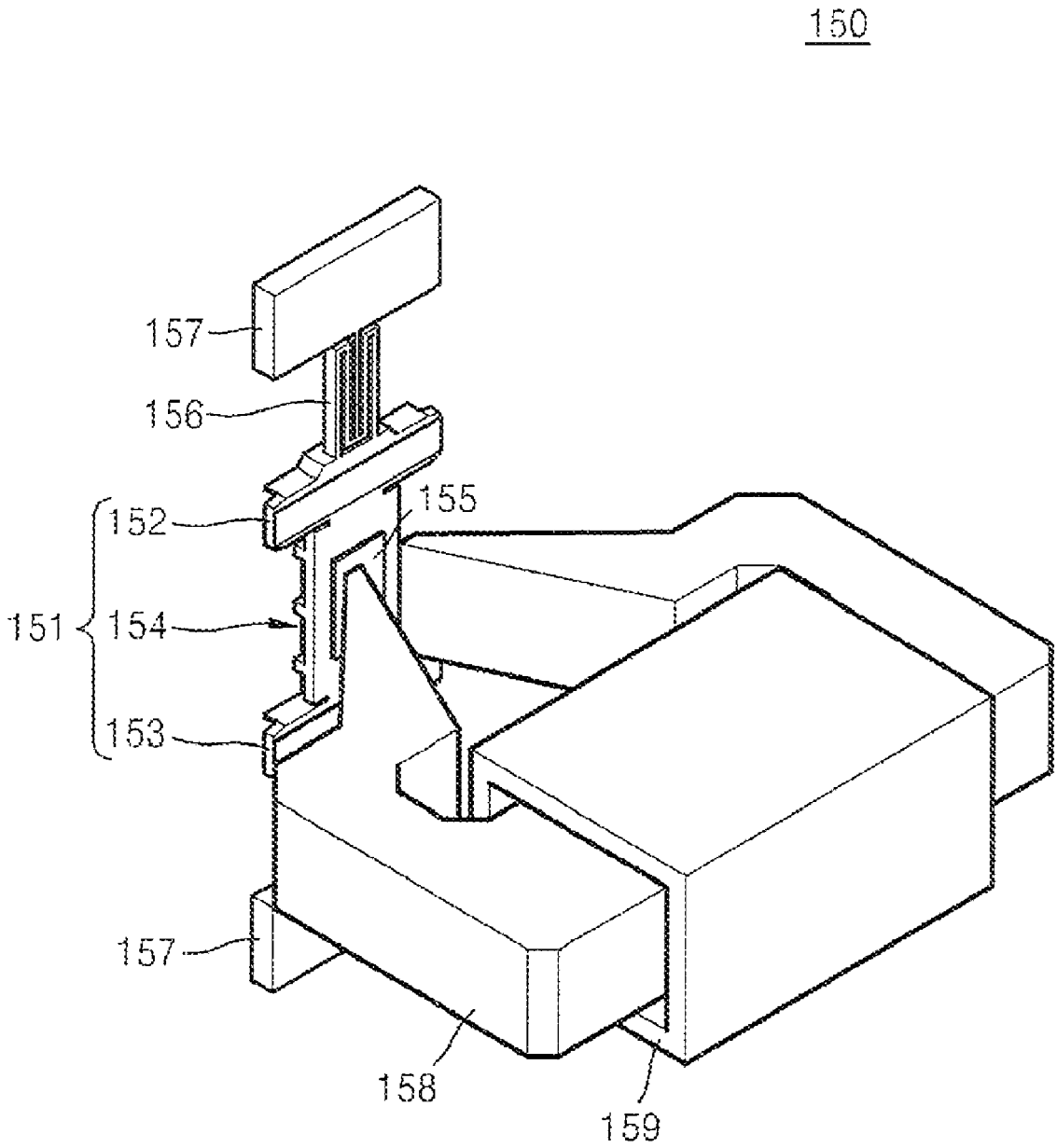
FIG. 2 is a perspective view of a beam deflector according to an embodiment of the present disclosure that can be used in the image forming apparatus of FIG. 1.
Figure 3:
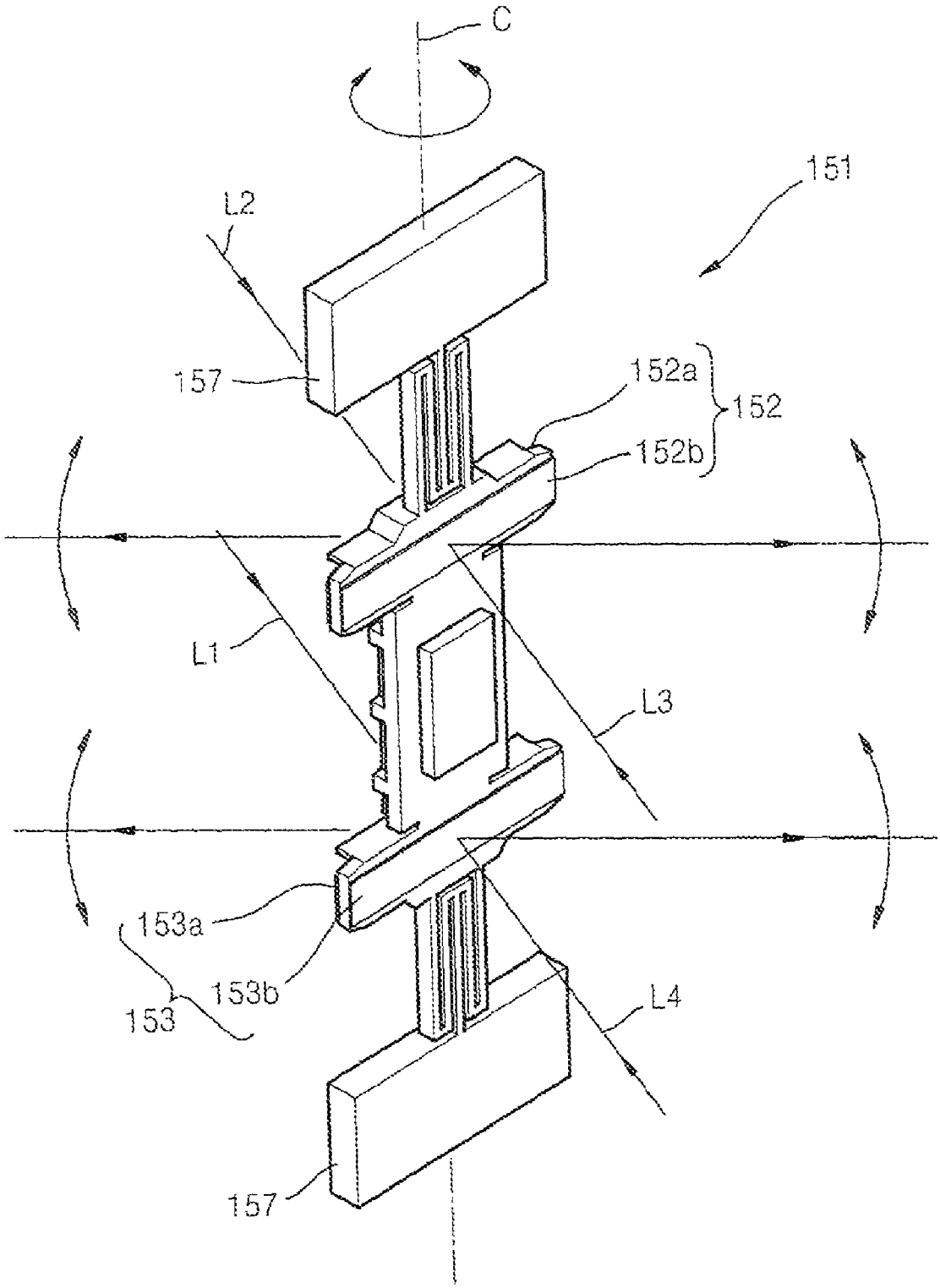
FIG. 3 illustrates an operation of deflection scanning light beams by using a double-sided mirror in the beam deflector of FIG. 2.

An example of a beam deflector used in the light scanning unit 100 according to an embodiment is shown in FIGS. 2 and 3. FIG. 2 is a perspective view of a beam deflector according to an embodiment of the present disclosure. FIG. 3 illustrates the operation of the deflection scanning of the light beams using a double-sided mirror of the beam deflector of FIG. 2.

Referring to FIGS. 2 and 3, a beam deflector 150 can include a double-sided mirror portion 151, a pair of springs 156, a pair of fixing ends 157, a yoke 158 and a coil 159 configured to encompass a portion of the yoke 158.

The double-sided mirror portion 151 can be configured to rotate and/or vibrate based on an electromagnetic driving force applied by the yoke 158 and the coil 159. The double-sided mirror portion 151 can include a first double-sided mirror 152, a second double-sided mirror 153 and a magnet frame 154, in which a permanent magnet 155 can be placed. A first mirror side 152*a* and a second mirror side 152*b* can each be arranged on the sides of the first double-sided mirror 152. A first mirror side 153*a* and a second mirror side 153*b* can each be each be arranged on the sides of the second double-sided mirror 153. According to an embodiment, the magnet frame 154 can be positioned between the first and second double-sided mirrors 152 and 153. The magnet frame 154 can rigidly couple together the first and second double-sided mirrors 152 and 153 so that the first and second double-sided mirrors 152 and 153 can rotate and/or vibrate as one body. The permanent magnet 155 can be disposed so that a direction of the magnetic flux associated with the permanent magnet 155 can be directed toward the yoke 158. The double-sided mirror portion 151 and the pair of fixing ends 157 can be connected by using the pair of springs 156. Each spring 156 can be configured to support one end of the double-sided mirror portion 151. The fixing ends 157 can be configured to support the pair of springs 156. The yoke 158 and the coil 159 can be used to apply an electromagnetic driving force, such as a periodic electromagnetic driving force, for example, to the double-sided mirror portion 151 through the electromagnetic interaction that can occur with the permanent magnet 155. The double-sided mirror portion 151 can resonate because of the periodic electromagnetic force and an elastic restoration force of the springs 156. As a result, the double-sided mirror portion 151 can vibrate in a sinusoidal manner about a C-axis (see FIG. 3). The beam deflector 150 can be a small-sized micro electro-mechanical system (MEMS) structure that can be made by using a process adapted for the manufacturing of such structures. Use of the beam deflector 150 can allow for a reduction in the size of the light scanning unit 100. In the current embodiment, the beam deflector 150 in which the first and second double-sided mirrors 152 and 153 are driven as one body has been described. In other embodiments, however, the first and second double-sided mirrors 152 and 153 can each include an independent MEMS structure and may be driven independently.

The first mirror side 152*a* of the first double-sided mirror 152 and the first mirror side 153*a* of the second double-sided mirror 153 can be placed on the same plane on one side of the beam deflector 150. The second mirror side 152*b* of the first double-sided mirror 152 and the second mirror side 153*b* of the second double-sided mirror 153 can be placed on the same plane on the opposite side of the beam deflector 150. As the double-sided mirror portion 151 rotates and/or vibrates, the first and second light beams L1 and L2 can be incident on the first mirror sides 152*a* and 153*a*, respectively, and can be scanned in the same direction, and the third and fourth light beams L3 and L4 can be incident on the second mirror sides 152*b* and 153*b*, respectively, and can be scanned in the same direction. Because the first mirror side 152*a* and the second mirror side 152*b* of the first double-sided mirror 152 are disposed at opposite sides of the beam deflector 150, and because the first mirror side 153*a* and the second mirror side 153*b* of the second double-sided mirror 153 are also disposed at opposite sides of the beam deflector 150, the direction, in which the first and second light beams L1 and L2 can be scanned, and the directions, in which the third and fourth light beams L3 and L4 can be scanned, are opposite directions.

The first through fourth light beams L1, L2, L3 and L4 can be scanned periodically. As a result, the directions in which the first and second light beams L1 and L2, and the third and fourth light beams L3 and L4 may respectively be expressed based on a phase associated with the scanned light beams. For example, the first and second light beams L1 and L2 can be scanned in phase with respect to each other, and the third and fourth light beams L3 and L4 can be scanned in phase with respect to each other. A phase difference, however, such as a 180 degree phase difference, for example, can occur between the scanning the first and second light beams L1 and L2 on one hand and the scanning of the third and fourth light beams L3 and L4 on the other hand. For example, the first and second light beams L1 and L2 can be scanned in phase with respect to each other, and can be defined as a first group of light beams. The third and fourth light beams L3 and L4 can be scanned in phase with respect to each other, but at a different phase from the scanning phase of the first group of light beams, and can be defined as a second group of light beams. In the description below, the references to the first group of light beams can be associated with images or optical signals caused by the first group of light beams while the references to the second group of light beams can be associated with images or optical elements caused by the second group of light beams. In the above-described embodiments, the first mirror sides 152*a* and 153*a* and the second mirror sides 152*b* and 153*b* can be placed at opposite sides of the beam deflector 150. In other embodiments, however, the first mirror sides 152*a* and 153*a* and the second mirror sides 152*b* and 153*b* can be disposed in such a manner that an angle formed between them is less than 180 degrees, that is, the first mirror sides 152*a* and 153*a* and the second mirror sides 152*b* and 153*b* need not be disposed opposite from one another.

Figure 4:
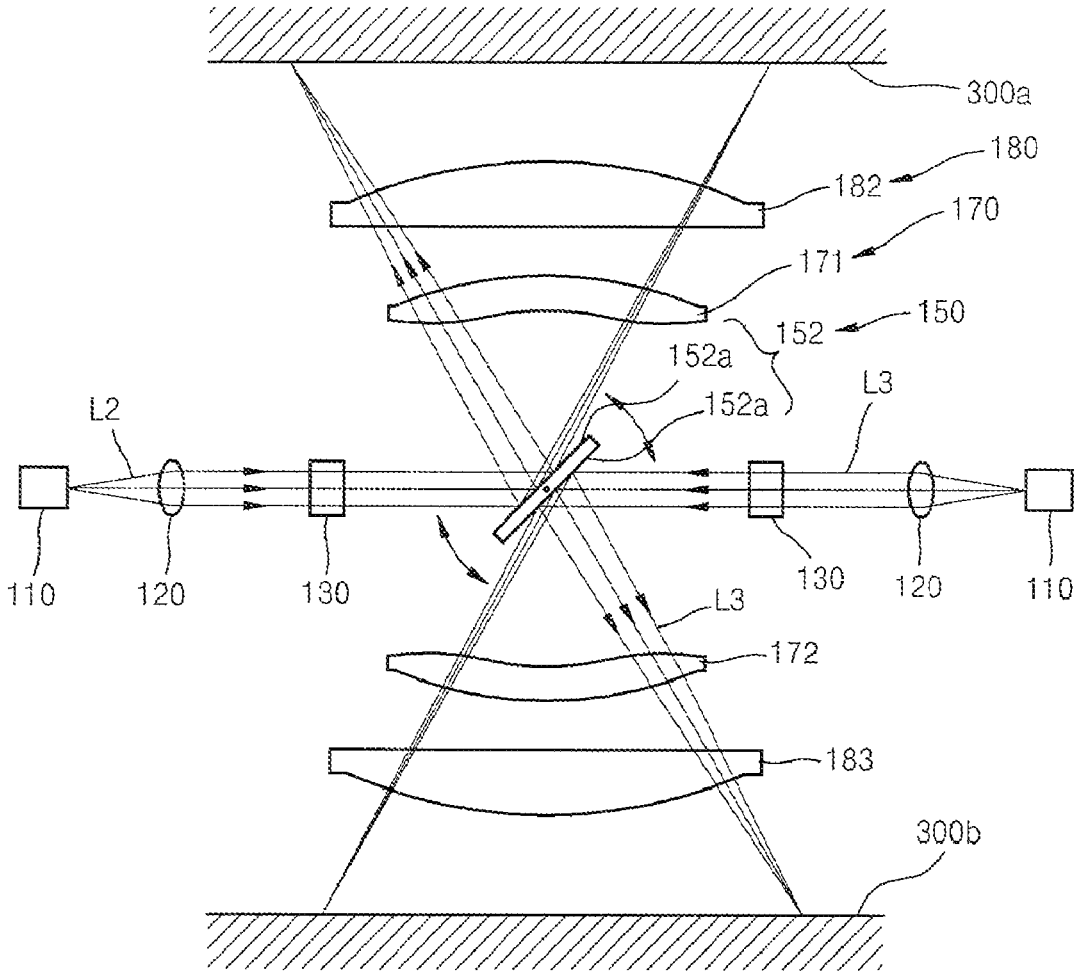
FIG. 4 illustrates a main scanning cross-section of a light scanning unit using the beam deflector of FIG. 2.
Figure 5:
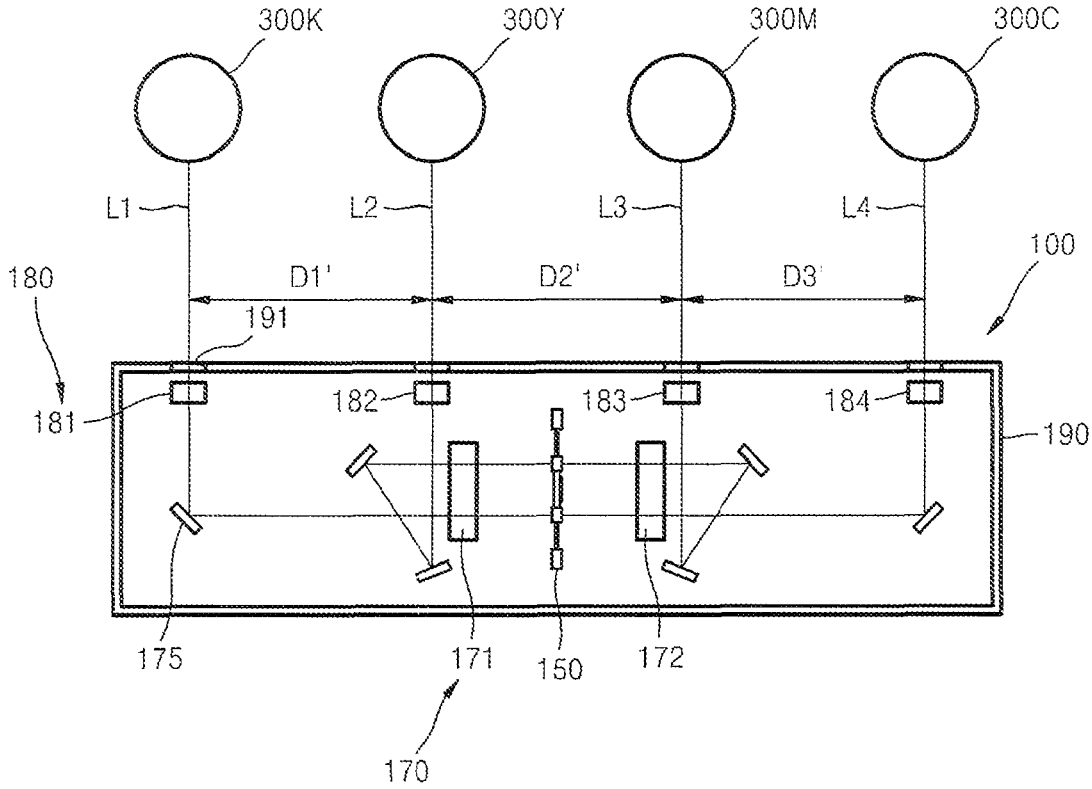
FIG. 5 illustrates a sub-scanning cross-section of the light scanning unit using the beam deflector of FIG. 2.

FIG. 4 illustrates a cross-section taken along the main scanning direction of the light scanning unit 100 using the beam deflector 150 of FIG. 2 according to an embodiment of the present disclosure. FIG. 5 illustrates the post-scan optical system of the light scanning unit 100 and a cross-section taken along the sub-scanning direction of each of the first through fourth photosensitive drums 300K, 300Y, 300M and 300C according to an embodiment of the present disclosure. In FIG. 4, for the sake of brevity, the mirror(s) (e.g., mirror 175 of FIG. 5) configured to fold an optical path is not shown, and only those components of an optical system disposed along the optical path of the second and third light beams L2 and L3 deflected by the first double-sided mirror 152 (see FIG. 3) is shown. In the example illustrated in FIG. 4, surfaces 300*a* and 300*b* to be scanned represent the outer circumferential surfaces of the second and third photosensitive drums 300Y and 300M, respectively.

Referring to FIGS. 4 and 5, the light scanning unit 100 can include a light source 110, a pre-scan optical system, a beam deflector 150, a post-scan optical system and a housing 190 which accommodates the afore-mentioned elements.

The light source 110 can include first through fourth light sources that are configured to emit first through fourth light beams L1, L2, L3 and L4, respectively. The first through fourth light beams L1, L2, L3 and L4 can be modulated according to black (K), yellow (Y), magenta (M) and cyan (C) image information, respectively. As described above, a phase difference of 180 degrees can occur between the scanning of the first and second light beams L1 and L2 and the scanning of the third and fourth light beams L3 and L4. Thus, a time difference corresponding to, for example, odd times associated with half of the vibration or oscillation period P of the beam deflector 150 can take place between an exposure starting time of the first and second light sources and an exposure starting time of the third and fourth light sources. The vibration period P of the beam deflector 150 can refer to a period of a sinusoidal vibration caused by resonance of the double-sided mirror portion 151. The exposure starting times of the first groups of light beams is described below in more detail when describing correction of a color registration error of the image forming apparatus with reference to FIGS. 6-9.

For each optical path defined by a light source 110 and the beam deflector 150, the pre-scan optical system can include a collimation lens 120 and a cylindrical lens 130 disposed along the optical path. The collimation lens 120 can be, for example, a focusing lens configured to change a light beam emitted by the light source 110 (e.g., the first through fourth light beams L1, L2, L3 and L4) into parallel light. The cylindrical lens 130 can be, for example, an anomorphic lens having a predetermined power only in the sub-scanning direction. The cylindrical lens 130 can be configured to focus light emitted by the light source 110 (e.g., the first through fourth light beams L1, L2, L3 and L4) on the beam deflector 150 in the sub-scanning direction. The pre-scan optical system can allow the first through fourth light beams L1, L2, L3 and L4 to be incident on the first and second mirror sides 152*a* and 153*a* and 152*b* and 153*b* of the beam deflector 150 in a cross-sectional shape in which cross-sections of the first through fourth light beams L1, L2, L3 and L4 are long in the main scanning direction and cross-sections of the first through fourth light beams L1, L2, L3 and L4 are short in the sub-scanning direction. In this manner, aberrations of the first through fourth light beams L1, L2, L3 and L4 because of deflection can be corrected, and the sizes of the first and second mirror sides 152*a* and 153*a* and 152*b* and 153*b* of the beam deflector 150 can be reduced so that the vibration characteristics of the beam deflector 150 can be improved.

The post-scan optical system can include a common imaging lens portion 170 and a separate imaging lens portion 180, which are disposed between one or more light sources 110 and the first through fourth photosensitive drums 300K, 300Y, 300M and 300C, for example. Reference numeral 175 in FIG. 5 denotes a mirror that folds, bends, or otherwise changes the direction of, an optical path. The common imaging lens portion 170 can include a first common imaging lens 171 and a second common imaging lens 172. The first common imaging lens 171 can be common to the first and second light beams L1 and L2, for example, and the second common imaging lens 172 can be common to the third and fourth light beams L3 and L4, for example. The first and second double-sided mirrors 152 and 153 can be fabricated to be adjacent to each other. Thus, the first and second common imaging lenses 171 and 172 can be small in size. Moreover, the common imaging lens portion 170 can be used so that the number of optical components in, and thus the size of, the light scanning unit 100 can be reduced. The separate imaging lens portion 180 can include first through fourth separate imaging lenses 181, 182, 183 and 184, which can be disposed on an optical path associated with each of the first through fourth light beams L1, L2, L3 and L4, respectively.

The post-scan optical system can function to converge images of the first through fourth light beams L1, L2, L3 and L4 on the surfaces to be scanned, e.g., the respective surfaces of the first through fourth photosensitive drums 300K, 300Y, 300M and 300C. Furthermore, the first through fourth light beams L1, L2, L3 and L4 can be deflected by the beam deflector 150 in accordance with the sinusoidal vibration of the beam deflector 150. A scanning velocity can thus have a sinusoidal curve. The post-scan optical system can also have a function that compensates for an error having an arcsine-like behavior so that the first through fourth light beams L1, L2, L3 and L4 can be imaged on the surfaces to be scanned of the first through fourth photosensitive drums 300K, 300Y, 300M and 300C at a substantially uniform velocity. In the post-scan optical system according to an embodiment, two imaging lenses can be disposed at a position along the optical path associated with each of the first through fourth light beams L1, L2, L3 and L4. The present disclosure, however, need not be so limited. In some embodiments, a single imaging lens or three or more imaging lenses can be disposed at a position along the optical paths. In addition, a separate imaging lens can alternatively be disposed at a position along each optical path in lieu of a common imaging lens.

The light source 110, the pre-scan optical system, the beam deflector 150 and the post-scan optical system can be disposed in the housing 190 with the folding of the optical path by the use of the mirror 175. It should be noted however the mirror 175 may not be necessary, and that the scanning direction from the beam deflector 150 need not be changed. Thus, a phase difference between scanning of the first group of light beams and scanning of the second group of light beams can be maintained. One or more windows 191 can be disposed in the housing 190 so that the first through fourth light beams L1, L2, L3 and L4 can exit the light scanning unit 100. The present disclosure need not be limited to the above-described structures for the pre-scan optical system or the post-scan optical system. Various modified examples of the pre-scan optical system and the post-scan optical system can be possible.

As described above, the phase difference of 180 degrees can occur between the scanning of the first and second light beams L1 and L2 and the scanning of the third and fourth light beams L3 and L4. Thus, the exposure starting times of the first through fourth light beams L1, L2, L3 and L4 and the intervals between the positions at which the first through fourth light beams L1, L2, L3 and L4 are scanned in the subscanning direction can be adjusted so that color registration can be corrected.

An optical arrangement and correction of a color registration error in the image forming apparatus according to an embodiment is described below with reference to FIG. 1 and FIGS. 6-9.

Figure 6:
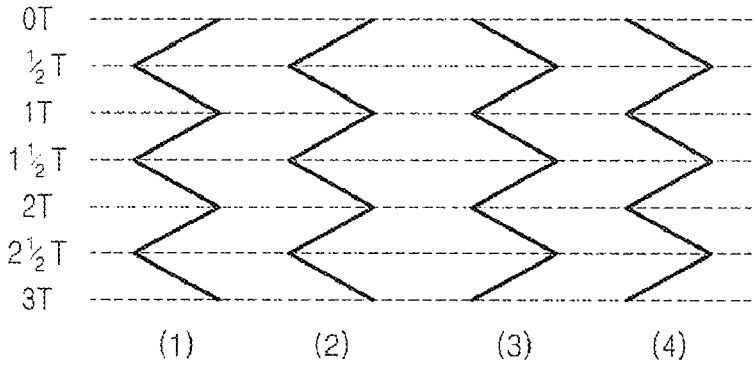
FIG. 6 illustrates tracks of light beams formed on four surfaces scanned by using the beam deflector of FIG. 2.
Figure 7:
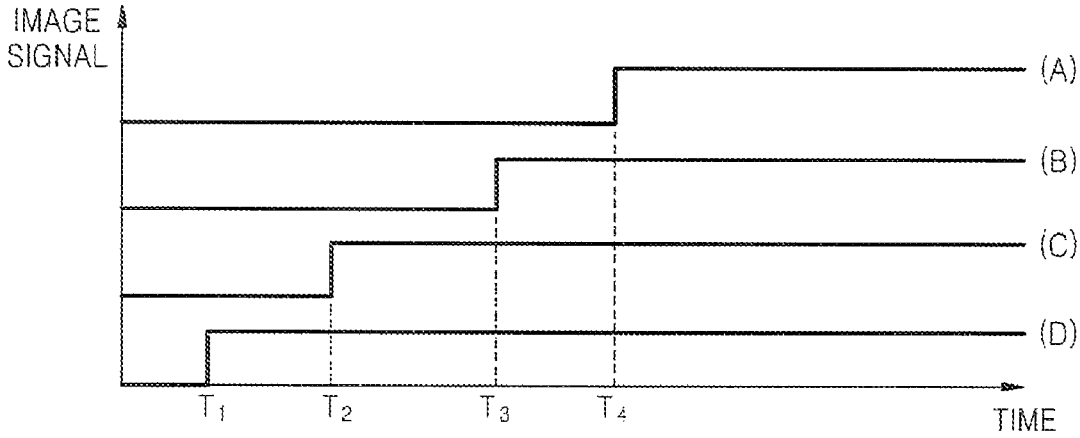
FIG. 7 illustrates starting timing of an image signal supplied to four light sources of a light scanning unit according to an embodiment of the present disclosure.

FIG. 6 illustrates tracks of light beams formed on four surfaces to be scanned by using the beam deflector described above with respect to FIG. 2. FIG. 7 illustrates the starting timings of the image signals supplied to four light sources of a light scanning unit according to an embodiment of the present disclosure.

Referring first to FIG. 6, the lines labelled (1), (2), (3) and (4) refer to the tracks of first through fourth light beams L1, L2, L3 and L4, respectively, on surfaces to be scanned, e.g., the surfaces of the first through fourth photosensitive drums 300K, 300Y, 300M and 300C when the exposure starting times of the first through fourth light beams L1, L2, L3 and L4 are substantially uniform. Referring to FIG. 6, the first and second light beams L1 and L2 can be scanned in phase with respect to each other while the third and fourth light beams L3 and L4 can be scanned in phase with respect to each other but at a phase that is different (e.g., by 180 degrees) from the phase at which the first and second light beams L1 and L2 are scanned. This is because, as described above, first mirror sides 152*a* and 153*a* and second mirror sides 152*b* and 153*b* of the beam deflector 150 are disposed on opposite sides of the beam deflector 150 so that the direction in which the first and second light beams L1 and L2 are scanned and the direction in which the third and fourth light beams L3 and L4 are scanned are opposite to each other.

Figure 8:
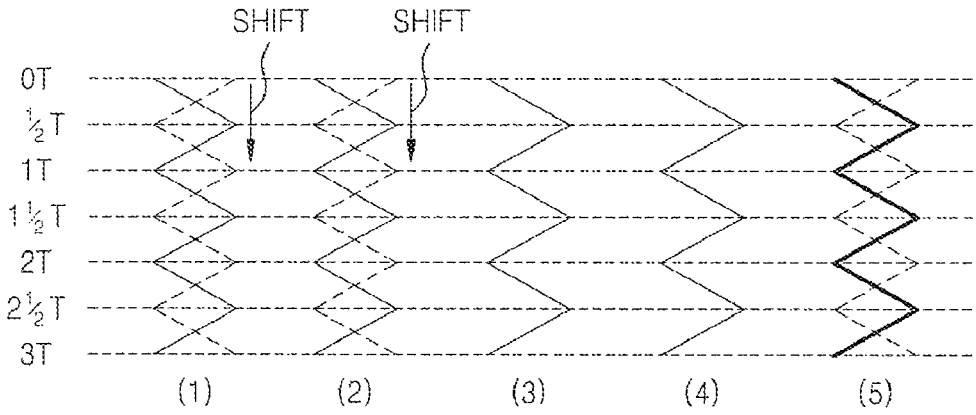
FIG. 8 illustrates color registration compensation according to an embodiment of the present disclosure.

Monochromic images formed on the first through fourth photosensitive drums 300K, 300Y, 300M and 300C can overlap when transferred to the intermediate transfer belt 500 of FIG. 1 (or when transferred directly onto a printing medium) to form a full color image. That is, such out of phase scanning of the light beams result in those individual monochromic images that overlap on the intermediate transfer belt 500 crossing one another as illustrated by a solid line and a dotted line crossing each other in a zigzag shape as shown in track (5) of FIG. 8. Color registration can refer to, for example, a method by which an exposure starting time of the light source unit 110 (see FIG. 2) can be adjusted so that multiple colors can be correctly transferred to the intermediate transfer belt 500. Because of the phase difference that can occur in scanning the first through fourth light beams L1, L2, L3 and L4, the monochromic images can cross one another in a zigzag pattern as illustrated in FIG. 8. The crossing that occurs can be referred to as a color registration error.

The image forming apparatus according to an embodiment of the disclosure can adjust the exposure starting times of the first through fourth light sources that emit the first through fourth light beams L1, L2, L3 and L4, respectively, and/or the positions at which the first through fourth photosensitive drums 300K, 300Y, 300M and 300C are disposed, to correct or minimize the color registration error.

In FIG. 7, the signals (A), (B), (C) and (D) represent the exposure timings associated with the first through fourth light sources 110, respectively. Referring to FIG. 7, the exposure starting times of the first through fourth light sources 110 can be adjusted to be different from each other so that cyan (C), magenta (M), yellow (Y) and black (K) monochromic images can properly overlap on the intermediate transfer belt 500.

Referring to FIGS. 1 and 7, as the intermediate transfer belt 500 travels, the monochromic images, for example, cyan (C), magenta (M), yellow (Y) and black (K) in that order, may be transferred onto the intermediate transfer belt 500 from the first through fourth photosensitive drums 300K, 300Y, 300M and 300C. In accordance with the exposure timing shown in. FIG. 7, exposures may proceed in the following order: the fourth light source 110, starts first at T1, the third light source 110 starts second at T2, the second light source 110 starts third at T3, and the first light source 110 starts fourth at T4. In such an embodiment, because the third and fourth light beams L3 and L4 are scanned in phase, the time interval (T2–T1) between the exposure starting time T2 of the third light source 110 and the exposure starting time T1 of the fourth light source 110 can be set to be a multiple of a vibration period P of the beam deflector 150. Similarly, the time interval (T4–T3) between the exposure starting time T4 of the first light source 110 and the exposure starting time T3 of the second light source 110 can be set to be a multiple of the vibration period P of the beam deflector 150. Because the second and third light beams L2 and L3 can be scanned at a phase difference of 180 degrees, the time interval (T2–T3) between the exposure starting time T3 of the second light source 110 and the exposure starting time T2 of the third light source 110 can be set to be an odd multiple of half of the vibration period P of the beam deflector 150.

The positions at which the first through fourth photosensitive drums 300K, 300Y, 300M and 300C are disposed can be selected to correspond to the exposure starting times T1, T2, T3 and T4 of the first through fourth light sources based on the travel velocity of the intermediate transfer belt 500. For example, the intermediate transfer belt 500 can move a distance D3 during the time interval T4–T3, a distance D2 during the time interval T3–T2, and a distance D1 during the time interval T2–T1. Thus, as shown in FIG. 1, the first and second photosensitive drums 300K and 300Y can be separated or offset from each other in the sub-scanning direction by a distance D1, the second and third photosensitive drums 300Y and 300M can be separated or offset from each other in the sub-scanning direction by a distance D2, and the third and fourth photosensitive drums 300M and 300C can be separated or offset from each other in the sub-scanning direction by a distance D3. The distances D1, D2 and D3 can be selected so that images produced by the first through fourth light beams L1, L2, L3 and L4 can overlap at substantially the same position on the intermediate transfer belt 500. In other words, D1, D2 and D3 can represent the distances associated with the positions at which the first through fourth photosensitive drums 300K, 300Y, 300M and 300C are to be disposed. In this example, the displacement distances D1, D2 and D3 can be based on the positions where cyan (C), magenta (M), yellow (Y) and black (K) monochromic images, in that order, can be transferred onto the intermediate transfer belt 500 from the first through fourth photosensitive drums 300K, 300Y, 300M and 300C, that is, the positions in which cyan (C), magenta (M), yellow (Y) and black (K) monochromic images are closest to the intermediate transfer belt 500 from the first through fourth photosensitive drums 300K, 300Y, 300M and 300C.

The distances D1, D2 and D3 described above can correspond to the exposure starting times T1, T2, T3 and T4 of the first through fourth light sources 110 by, for example, satisfying Equations 1 and 2 shown below.

$$D1 = D3 \pm DP \cdot (m-1) \quad \text{(Equation 1)}$$

$$D2 = D1 \pm (DP/2) \cdot (2n-1) \quad \text{(Equation 2)}$$

In Equations 1 and 2 above, DP represents a distance traveled by the intermediate transfer belt 500 in the sub-scanning direction during a vibration period P of the beam deflector 150, and the indices m and n are natural numbers (i.e., positive integers greater than 0). For example, the displacement distances D1, D2 and D3 can be selected based on m=n=1. In other examples, the displacement distances D1, D2, and D3 can be selected based on an index m that is different from the index n.

Referring to Equation 2, the displacement distance D2 can be larger or smaller than the displacement distance D1 by (DP/2)·(2n−1). For example, when the displacement distance D2 is larger than the displacement distance D1 by (DP/2)·(2n−1), the exposure starting times T1 and T2 of the first and second light beams L1 and L2, respectively, are delayed by a time interval (P/2)·(2n−1) so that the color registration error can be corrected. In another example, when the displacement distance D2 is smaller than the displacement distance by (DP/2)·(2n−1), the exposure starting times T3 and T4 of the third and fourth light beams L3 and L4, respectively, are delayed by a time interval (P/2)·(2n−1) so that the color registration error can be corrected. In the above-described examples, P is the vibration period of the beam deflector 150. By using a time interval that corresponds to odd multiples of half of the vibration period P of the beam deflector 150 to separate the exposure starting times T1 and T2 of the first and second light beams L1 and L2 on one hand and the exposure starting times T3 and T4 of the third and fourth light beams L3 and L4 on the other hand, the color registration error can be corrected. A more specific examples of color registration error correction is described below with reference to FIGS. 8 and 9.

As illustrated in FIG. 1, when the first through fourth photosensitive drums 300K, 300Y, 300M and 300C are arranged in a parallel configuration along one side of the intermediate transfer belt 500, the displacement distances D1, D2 and D3 between the first through fourth photosensitive drums 300K, 300Y, 300M and 300C can be substantially the same as the scanning distances D1', D2', and D3' between the first through fourth light beams L1, L2, L3 and L4. Thus, Equations 1 and 2 can be modified as shown in Equations 3 and 4 below to illustrate the relationship between the scanning distances D1', D2' and D3' of the first through fourth light beams L1, L2, L3 and L4.

$$D1' = D3' \pm D \cdot (m-1) \quad \text{(Equation 3)}$$

$$D2' = D1' \pm (D/2) \cdot (2n-1) \quad \text{(Equation 4)}$$

In Equations 3 and 4 above, D1' is the distance associated with the scanning of the first and second light beams L1 and L2, D2' is the distance associated with the scanning of the second and third light beams L2 and L3, and D3' is the distance associated with the scanning of the third and fourth light beams L3 and L4. D is the distance traveled by the intermediate transfer belt 500 in the sub-scanning direction during a vibration period P of the beam deflector 150.

FIG. 8 illustrates color registration error compensation according to an embodiment of the present disclosure. In the embodiment of FIG. 8, the displacement distances D1, D2, and D3 of the first through fourth photosensitive drums 300K, 300Y, 300M and 300C can satisfy Equations 5 and 6 below.

$$D1 = D3 \quad \text{(Equation 5)}$$

$$D2 = D1 + (½) \cdot DP \quad \text{(Equation 6)}$$

In this example, the displacement distance D2 is chosen to be larger than the displacement distance D1 by (½)·DP. Referring to tracks (1), (2), (3) and (4) of FIG. 8, a solid line represents each of scanning tracks of the first through fourth light beams L1, L2, L3 and L4 on the surfaces to be scanned, e.g., the surfaces of the first through fourth photosensitive drums 300K, 300Y, 300M and 300C when the exposure starting times T1 and T2 of the first and second light beams L1 and L2 are delayed by half of the vibration period P of the beam deflector 150. In addition, a dotted line represents each of scanning tracks of the first through fourth light beams L1, L2, L3 and L4 on surfaces to be scanned of the first through fourth photosensitive drums 300K, 300Y, 300M and 300C without a delay in the exposure starting times T1 and T2 of the first and second light beams L1 and L2. In tracks (1) and (2) of FIG. 8, the solid lines show the tracks formed when the exposure timing starts of the first and second light beams L1 and L2 are shifted by half of the vibration period P of the beam deflector 150. In FIG. 8, tracks (1), (2), (3) and (4) are formed by starting the exposure of each of the first through fourth light sources 110 at 0T.

In addition, referring to track (5) of FIG. 8, a solid bold line can represent the tracks (i.e., images) formed on the first through fourth photosensitive drums 300K, 300Y, 300M and 300C that overlap on the intermediate transfer belt 500 as being in phase when the exposure starting times T1 and T2 of the first and second light beams L1 and L2 are delayed by half of the vibration period P of the beam deflector 150. When a delay does not occur in the exposure starting times T1 and T2 of the first and second light beams L1 and L2, the tracks formed by the first and second light beams L1 and L2 overlap with tracks formed by the third and fourth light beams L3 and L4 at a phase difference of 180 degrees, as shown by the dotted line in track (5) of FIG. 8. In other words, in track (5) of FIG. 8, the exposure starting times T1 and T2 of the first and second light beams L1 and L2 are delayed by half of the vibration period P of the beam deflector 150 so that the color registration error can be corrected.

Figure 9:
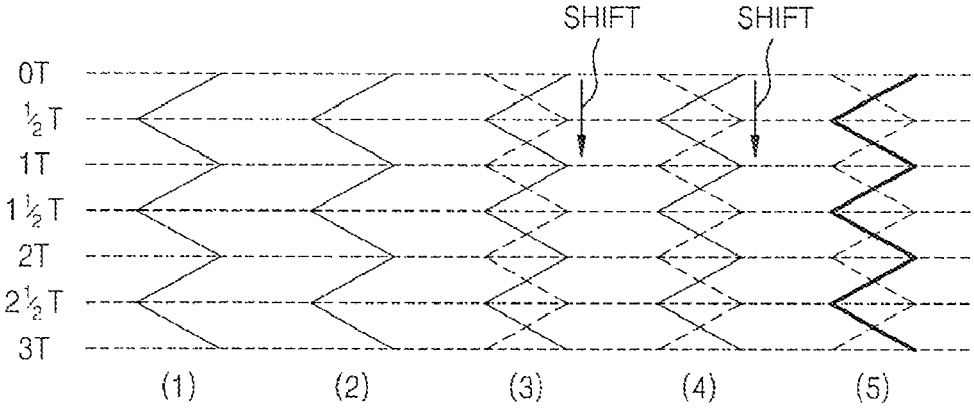
FIG. 9 illustrates color registration compensation according to another embodiment of the present disclosure.

FIG. 9 illustrates color registration error compensation according to another embodiment of the present disclosure. In the embodiment of FIG. 9, the displacement distances D1, D2, and D3 of the first through fourth photosensitive drums 300K, 300Y, 300M and 300C can satisfy Equations 7 and 8 below.

$$D1=D3 \quad \text{(Equation 7)}$$

$$D2=D1-(1/2)\cdot DP \quad \text{(Equation 8)}$$

In this example, different from the example described with respect to FIG. 8, the displacement distance D2 is chosen to be smaller than the displacement distance D1 by (½)·DP. The exposure starting times T3 and T4 of the third and fourth light beams L3 and L4 can be delayed by half of the vibration period P of the beam deflector 150.

Referring to tracks (1), (2), (3) and (4) of FIG. 9, a solid line represents each of the scanning tracks of the first through fourth light beams L1, L2, L3 and L4 on the surfaces to be scanned, e.g., the surfaces of the first through fourth photosensitive drums 300K, 300Y, 300M and 300C when the exposure starting times T3 and T4 of the third and fourth light beams L3 and L4 are delayed by half of the vibration period P of the beam deflector 150. In addition, a dotted line represents each of the scanning tracks of the first through fourth light beams L1, L2, L3 and L4 on surface to be scanned of the first through fourth photosensitive drums 300K, 300Y, 300M and 300C without a delay in the exposure starting times T3 and T4 of the third and fourth light beams L3 and L4. In tracks (3) and (4) of FIG. 9, the solid lines show the tracks formed when the exposure starting times of the third and fourth light beams L3 and L4 are shifted by half of the vibration period P of the beam deflector 150. In FIG. 9, tracks (1), (2), (3) and (4) are formed by starting the exposure of each of the first through fourth light sources 110 at 0T.

In addition, referring to track (5) of FIG. 9, a solid bold line represents the tracks (i.e., images) formed on the first through fourth photosensitive drums 300K, 300Y, 300M and 300C that overlap on the intermediate transfer belt 500 as being in phase when the exposure starting times T3 and T4 of the third and fourth light beams L3 and L4 are delayed by half of the vibration period P of the beam deflector 150. In other words, in track (5) of FIG. 9, the exposure starting times T3 and T4 of the third and fourth light beams L3 and L4 are delayed by half of the vibration period P of the beam deflector 150 so that the color registration error can be corrected.

Figure 10:
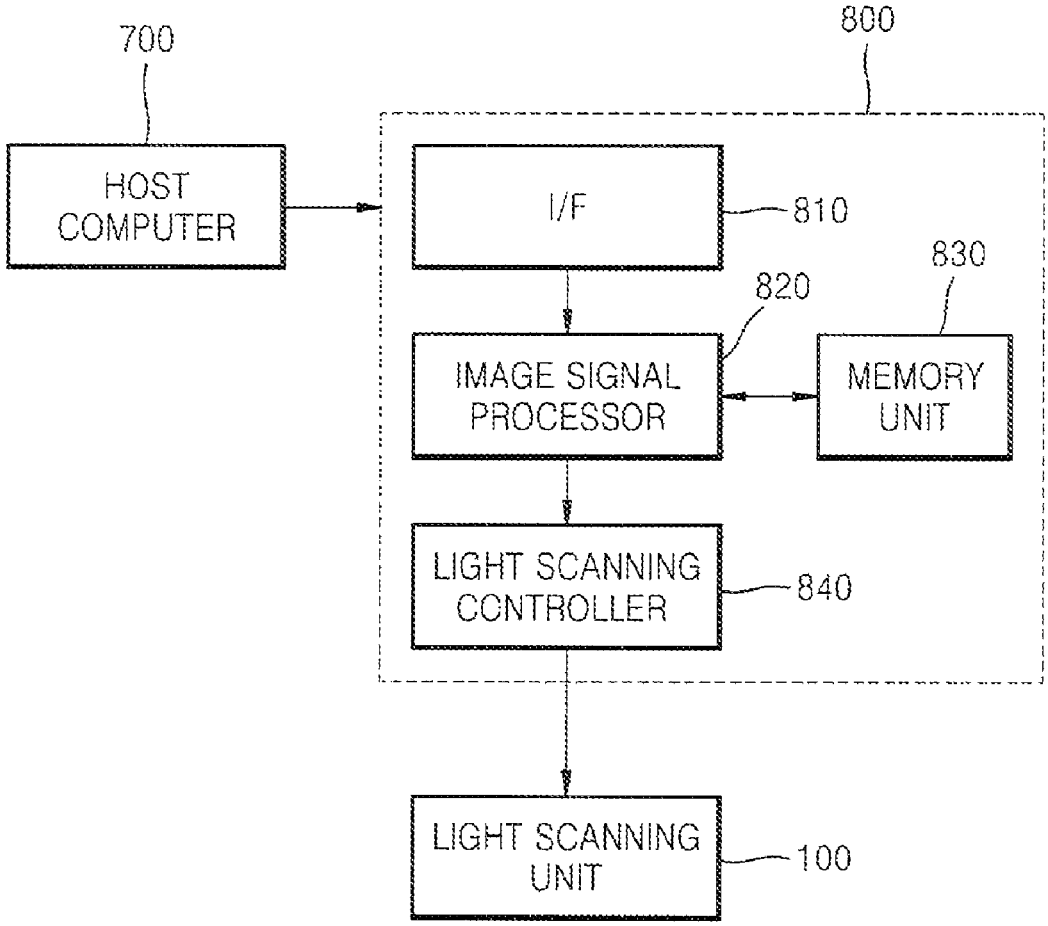
FIG. 10 is a block diagram illustrative of an embodiment of a controller for controlling an exposure starting time of a light scanning unit of the image forming apparatus of FIG. 1.

FIG. 10 is a block diagram of a controller according to an embodiment of the present disclosure capable of controlling the exposure starting times of a light scanning unit 100.

Referring to FIG. 10, a controller 800 of the image forming apparatus can be configured to control a light scanning unit 100 by using image information and/or control information provided from a host computer 700. The controller 800 can include an interface (I/F) unit 810, an image signal processor 820, a memory unit 830 and a light scanning controller 840. The I/F unit 810 can be configured to transmit the image information and the control information received from the host computer 700 to the image signal processor 820. The image signal processor 820 can be configured to separate the input image information according to colors. Moreover, the image signal processor 820 can be configured to transmit the image information of a group of light sources associated with the first group of light beams (e.g., first and second light beams L1 and L2) or of a group of light sources associated with the second group of light beams (e.g., third and fourth light beams L3 and L4) to the memory unit 830. The image signal processor 820 can be configured to delay the image information by half of the vibration period P of the beam deflector 150. For example, in the example described above with respect to FIG. 8, the image signal processor 820 can transmit image information of the first and second light sources 110 to the memory unit 830 and can delay the image information by half of the vibration period P of the beam deflector 150. The light scanning controller 840 can be configured to demodulate an output of the light source 110 in the light scanning unit 100 according to the input image information, and can be configured to control the development and the transfer operations. The light scanning unit 100 can be configured to emit the first and second groups of light beams with a time interval corresponding to half of the vibration period P of the beam deflector 150. As a result, images can overlap at a predetermined position of the intermediate transfer belt 500 in phase.

Figure 11:
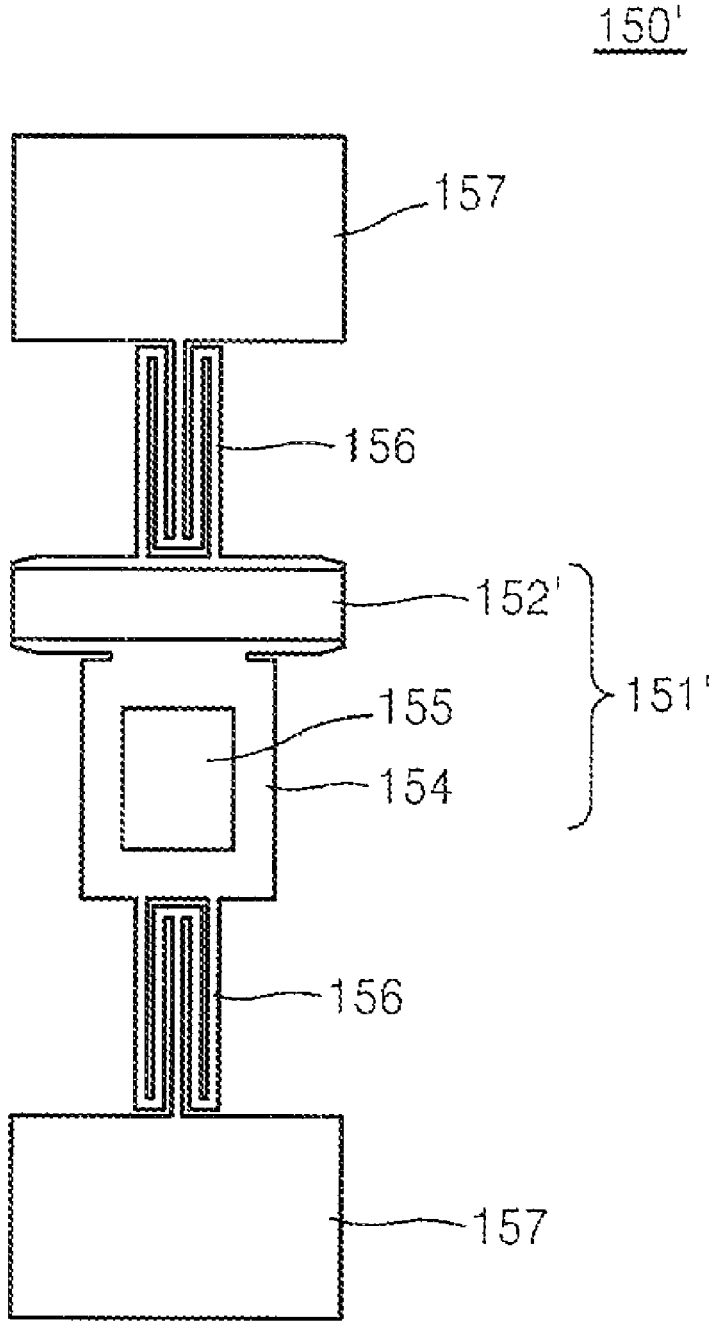
FIG. 11 illustrates a beam deflector according to another embodiment of the present disclosure that can used in the image forming apparatus of FIG. 1.
Figure 12:
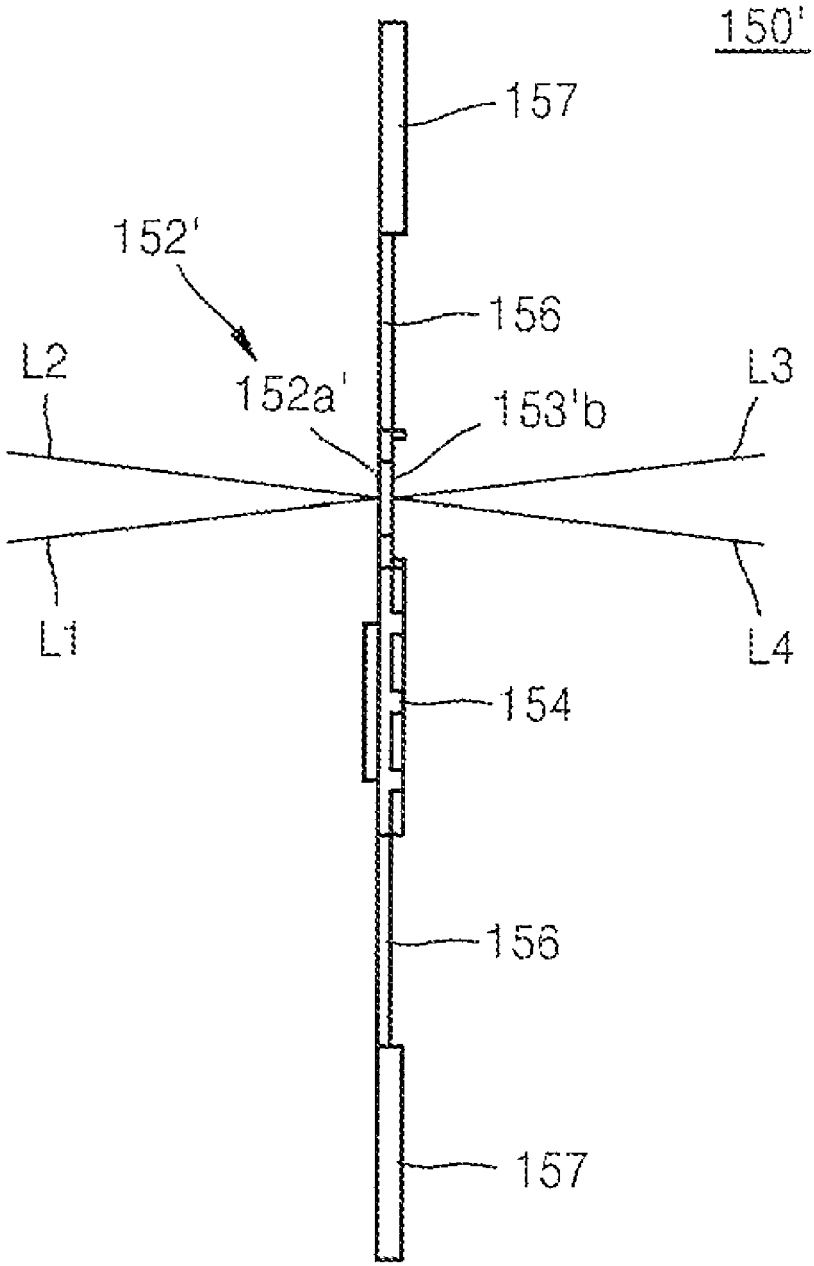
FIG. 12 illustrates light beams incident on a double-sided mirror of the beam deflector of FIG. 11.
Figure 13:
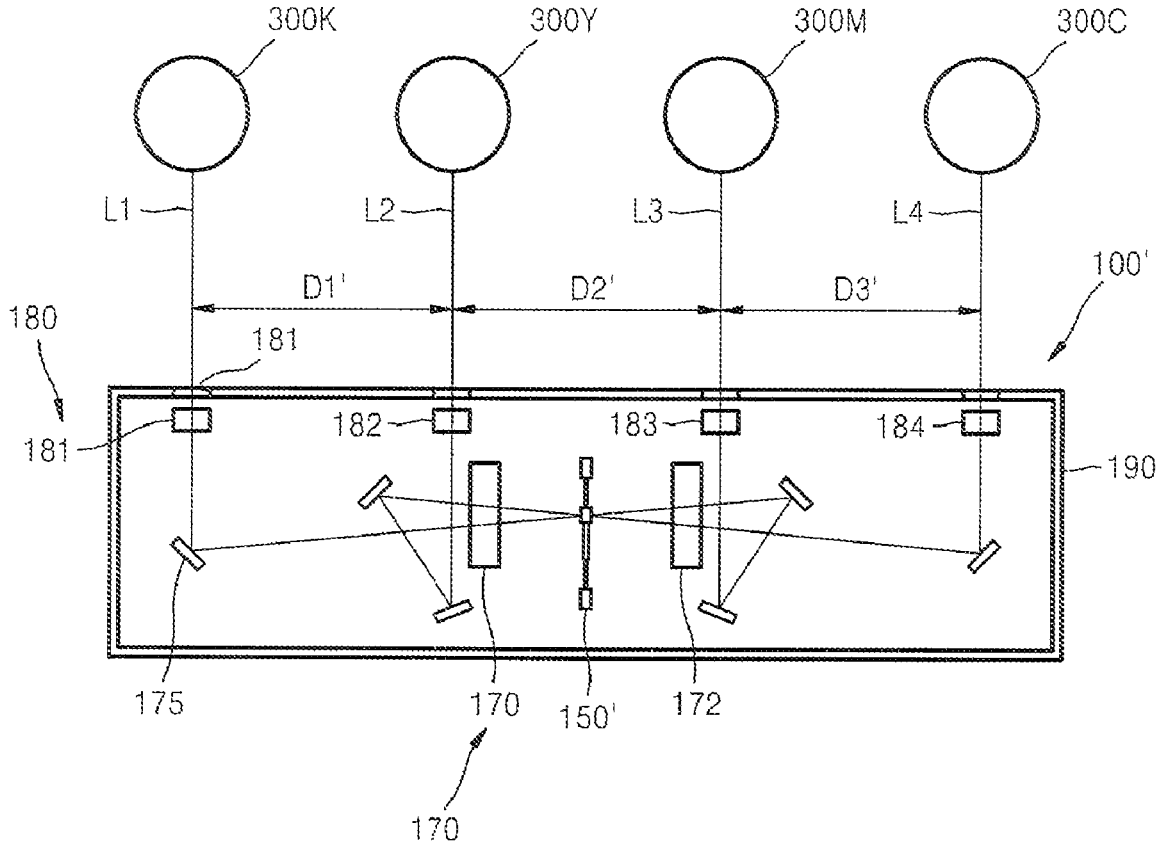
FIG. 13 illustrates a sub-scanning cross-section of the light scanning unit including the beam deflector of FIG. 11.

FIGS. 11-13 illustrate a light scanning unit according to another embodiment of the present disclosure that can be used in the image forming apparatus of FIG. 1.

FIG. 11 is a perspective view of a beam deflector according to an embodiment of the present disclosure. FIG. 12 illustrates light beams incident on a double-sided mirror of the beam deflector of FIG. 11. FIG. 13 illustrates a sub-scanning cross-section of the light scanning unit using the beam deflector of FIG. 11.

Referring to FIGS. 11 and 12, a beam deflector 150' according to the current embodiment may include a double-sided mirror portion 151', a pair of springs 156 and a pair of fixing ends 157. A yoke and a coil that apply an electromagnetic driving force to the double-sided mirror portion 151' are not shown. The beam deflector 150' according to the current embodiment is different from the beam deflector 150 described previously with reference to FIGS. 2 and 3 in that the double-sided mirror portion 151' has only one double-sided mirror 152'. Remaining elements of the beam deflector 150' of FIG. 11 may be substantially the same as those of the beam deflector 150 of FIGS. 2 and 3.

The beam deflector 150' can include one double-sided mirror 152'. Thus, the first and second light beams L1 and L2 can be incident on a first mirror side 152'*a* of the double-sided mirror 152' at different incidence angles, and the third and fourth light beams L3 and L4 can be incident on a second mirror side 152'*b* of the double-sided mirror 152' at different incidence angles. The first and second light beams L1 and L2 can be deflected by the same first mirror side 152'*a* and can be scanned in phase. Similarly, the third and fourth light beams can be deflected on the same second mirror side 152'*b* and can be scanned in phase. That is, the first and second light beams L1 and L2 can be scanned in phase with respect to each other while the third and fourth light beams L3 and L4 can be scanned in phase with respect to each other. A phase difference, however, such as a phase difference of 180 degrees, for example, can occur between the scanning of the first and second light beams L1 and L2 on one hand and the scanning of the third and fourth light beams L3 and L4 on the other hand.

Referring to FIG. 13, a light scanning unit 100' according to an embodiment can include a light source 110, a pre-scan optical system, a beam deflector 150', a post-scan optical system and a housing 190 configured to accommodate the afore-mentioned elements. Some elements of the light scanning unit 100' according to the current embodiment can be substantially the same as those of the light scanning unit 100 described above with respect to FIGS. 4 and 5. Thus, a detailed description thereof need not be repeated. The beam deflector 150' is described above with respect to FIGS. 11 and 12. In the embodiment associated with FIG. 13, a common imaging lens portion 170 and/or a separate imaging lens portion 180 of the post-scan optical system can have, for example, an aspheric shape to account for the non-parallel nature of the first through fourth light beams L1, L2, L3 and L4 deflected by the beam deflector 150'.

Because a phase difference can occur when scanning the first through fourth light beams L1, L2, L3 and L4, a color registration error correction may be needed. A method and structure for correcting the color registration error can be substantially the same as those described above with respect to some of the embodiments of FIGS. 1-9. In other words, a time interval corresponding to odd multiples of half of the vibration period P of the beam deflector 150' can be used to adjust the exposure starting times of the first through fourth light beams L1, L2, L3 and L4. Moreover, the displacement distances D1, D2, and D3 associated with the first through fourth photosensitive drums 300K, 300Y, 300M and 300C in the sub-scanning direction or the sub-scanning distances D1', D2' and D3' associated with the first through fourth light beams L1, L2, L3 and L4 in the sub-scanning direction can correspond to the exposure starting times of the first through fourth light beams L1, L2, L3 and L4 and can be designed or chosen according to Equations 1-4 described above.

The above-described embodiments refer to forming a color image by using four colors. The present disclosure, however, need not be so limited. In one embodiment, the color image can be formed by using fewer than four colors, such as by using magenta (M), yellow (Y) and cyan (C). In another embodiment, the color image can be formed by adding other monochromic images. For example, red (R), blue (B) and/or green (G) can be added to magenta (M), yellow (Y) and cyan (C) to improve the quality of the color image. In such embodiments, the number of light beams associated with to first and second group of light beams can be smaller or larger than two light beams.

Moreover, the above-described embodiments have made reference to a beam deflector having one or two double-sided mirrors. The present disclosure, however, need not be so limited. The beam deflector can include three or more double-sided mirrors.

As described above, in the image forming apparatus and method of correcting color registration according to the present disclosure, a color registration error that occurs when a double-sided mirror is used as a beam deflector of a light scanning unit can be corrected.

While the disclosure has been particularly shown and described with reference to several embodiments thereof with particular details, it will be apparent to one of ordinary skill in the art that various changes may be made to these embodiments without departing from the principles and spirit of the disclosure, the scope of which is defined in the following claims and their equivalents.

What is claimed is:

1. An image forming apparatus, comprising:

one or more light sources configured to emit at least a first light beam and a second light beam;

a beam deflector that includes a double mirror portion having a first mirror and a second mirror that are not coplanar with respect to each other, the double mirror portion being configured to pivot about a pivotal axis that extends substantially parallel to the surfaces of the first and second mirrors such that respective light beams deflected by the first mirror and the second mirror are out of phase with respect to each other by a deflected phase difference;

a first photosensitive member configured to receive the first light beam reflected by the first mirror of the beam deflector, a first image being formed on the first photosensitive member;

a second photosensitive member configured to receive the second light beam reflected by the second mirror of the beam deflector, a second image being formed on the second photosensitive member; and a transfer medium configured to receive the first image from the first photosensitive member and the second image from the second photosensitive member, wherein the first light beam and the second light beam having a timing difference therebetween such that, when the first and second images are respectively transferred onto the transfer medium, the transferred second image overlaps with the transferred first image substantially in phase, and wherein a distance between the first photosensitive member and the second photosensitive member along a sub-scanning direction of the image forming apparatus corresponds to an odd multiple of half of a distance the transfer member travels during a pivot period of the beam deflector during which the double mirror portion range of its pivoting motion.

2. The image forming apparatus of claim 1, wherein the first and second mirrors are arranged on opposite sides of the double mirror portion such that the deflected phase difference is 180 degrees, and wherein the timing difference is an odd multiple of half the pivot period of the beam deflector.

3. The image forming apparatus of claim 1, further comprising a pre-scan optical system disposed along an optical path defined between the one or more light sources and the beam deflector.

4. The image forming apparatus of claim 3, wherein the pre-scan optical system includes a collimation lens and a cylindrical lens.

5. The image forming apparatus of claim 1, wherein the double mirror portion of the beam deflector is constructed as a micro electro-mechanical (MEMS) structure configured to vibrate in a sinusoidal manner.

6. The image forming apparatus of claim 1, wherein the double mirror portion includes a plurality of first mirrors arranged on a first side of the beam deflector and a plurality of second mirrors arranged on a second side of the beam deflector opposite the first side, the first light beam comprising a first group of light beams that includes a first plurality of light beams, the second light beam comprising a second group of light beams that includes a second plurality of light beams, the first plurality of light beams being incident on the corresponding ones of the plurality of first mirrors substantially parallel to one another, the second plurality of light beams being incident on the corresponding ones of the plurality of second mirrors substantially parallel to one another.

7. The image forming apparatus of claim 1, wherein the double mirror portion includes a first mirror arranged on a first side of the beam deflector and a second mirror arranged on a second side of the beam deflector opposite the first side, the first light beam comprising a first group of light beams that includes a first plurality of light beams, the second light beam comprising a second group of light beams that includes a second plurality of light beams, the first mirror being configured to receive light beams from the first group of light beams at different angles of incidence, the second mirror being configured to receive light beams from the second group of light beams at different angles of incidence.

8. The image forming apparatus of claim 1, further comprising a post-scan optical system configured to image the first light beam on the first photosensitive member and to image the second light beam on the second photosensitive of member.

9. The image forming apparatus of claim 8, wherein: the double mirror portion of the beam deflector is configured to vibrate in a sinusoidal manner, and wherein the post-scan optical system is configured to apply an arcsine-like function so as to compensate for the sinusoidal manner vibration of the double mirror portion so that the first and second light beams are each imaged at a substantially uniform velocity.

10. The image forming apparatus of claim 1, wherein the first light beam and the second light beam being spaced apart along a sub-scanning direction by a distance substantially same as the distance between the first photosensitive member and the second photosensitive member.

11. The image forming apparatus of claim 1, wherein the first light beam comprises a first group of light beams that includes the first light beam and a third light beam, the second light beam comprising a second group of light beams that includes the second light beam and a fourth light beam, the first group of light beams being modulated with information corresponding to a first group of monochromic images, the second group of light beams being modulated with information corresponding to a second group of monochromic images different from the first group of monochromic images.

12. The image forming apparatus of claim 11, wherein the first group of monochromic images includes two images from among yellow (Y), magenta (M), cyan (C) and black (K) images, and the second group of monochromic images includes the remaining two images from among yellow (Y), magenta (M) cyan (C) and black (K) images.

13. The image forming apparatus of claim 1, wherein the first light beam comprises a first group of light beams that includes a first plurality of light beams, the second light beam comprising a second group of light beams that includes a second plurality of light beams, wherein the first mirror comprises a first group of one or more mirrors coplanar with respect to each other so as to reflect light beams in phase with respect to each other, the second mirror comprising a second group of one or more mirrors coplanar with respect to each other so as to reflect light beams in phase with respect to each other, the first and second groups of mirrors not being coplanar with respect to each other such that light beams deflected by the first group of one or more mirrors are out of phase with light beams deflected by the second group of one or more mirrors by the deflected phase difference, wherein the first photosensitive member comprises a first group of photosensitive members that includes a first plurality of photosensitive members each configured to receive a respective corresponding one of the first plurality of light beams from the first group of one or more mirrors, the second photosensitive member comprising a second group of photosensitive members that includes a second plurality of photosensitive members each configured to receive a respective corresponding one of the second plurality of light beams from the second group of one or more mirrors, the first and second plurality of photosensitive members being arranged to satisfy relationships defined by:

$$D1=D3\pm DP\cdot(m-1);\text{ and}$$

$$D2=D1\pm(DP/2)\cdot(2n-1),\text{ and}$$

wherein D1 corresponds to a first distance by which two adjacent ones of the first plurality of photosensitive members are spaced apart from each other along the sub-scanning direction, D2 corresponding to a second distance between any one of the first plurality of photosensitive members and any one of the second plurality of photosensitive members adjacent to each other along the sub-scanning direction, D3 corresponding to a third distance by which two adjacent ones of the second plurality of photosensitive members are spaced apart from each other along the sub-scanning direction, DP corresponding to the distance the transfer member travels during the pivot period of the beam deflector, n and m each being a positive integer greater than zero.

14. The image forming apparatus of claim 13, wherein the first group of photosensitive members is disposed downstream of the second group of photosensitive members with respect to a direction of travel of the transfer medium along the sub-scanning direction, and wherein the distance D2 is larger than the distance D1 by (DP/2)·(2n−1), a timing of the first group of light beams being delayed by (P/2)·(2n−1) with respect to the second group of light beams, P corresponding to the pivot period of the beam deflector.

15. The image forming apparatus of claim 13, wherein the first group of photosensitive members is disposed downstream of the second group of photosensitive members with respect to a direction of travel of the transfer medium along the sub-scanning direction, and wherein the distance D2 is smaller than the distance D1 by (DP/2)·(2n−1), a timing of the second group of light beams being delayed by (P/2)·(2n−1) with respect to the first group of light beams, P corresponding to the pivot period of the beam deflector.

16. The image forming apparatus of claim 13, wherein relative positions of each of the first and second plurality of light beams incident on a respective corresponding one of the first and second plurality of photosensitive members satisfy relationships defined by:

$$D1'=D3'\pm D\cdot(m-1);\text{ and}$$

$$D2'=D1'\pm(D/2)\cdot(2n-1),\text{ and}$$

wherein D1' corresponds to a fourth distance by which two adjacent ones of the first plurality of light beams are spaced apart from each other along the sub-scanning direction, D2' corresponding to a fifth distance between any one of the first plurality of light beams and any one of the second plurality of light beams adjacent to each other along the sub-scanning direction, D3' corresponding to a sixth distance by which two adjacent ones of the second plurality of light beams are spaced apart from each other along the sub-scanning direction, D corresponding to the distance the transfer member travels during the pivot period of the beam deflector.

17. A method of forming a color image, comprising:

scanning a first group of light beams associated with a first group of monochromic images on a first group of photosensitive members by deflecting the first group of light beams with a beam deflector toward the first group of photosensitive members, the beam deflector including a double mirror portion having a first group of one or more mirrors coplanar with respect to each other and a second group of one or more mirrors that are not coplanar with the first group of one or more mirrors, the double mirror portion being configured to pivot about a pivotal axis that extends substantially parallel to the surfaces of the first and second groups of one or more mirrors such that respective light beams deflected by the first group of one or more mirrors and the second group of one or more mirrors are out of phase with respect to each other by a deflected phase difference, the first group of light beams being deflected off the first group of one or more mirrors of the beam deflector to form a first group of latent images on the first group of photosensitive members;

scanning a second group of light beams associated with a second group of monochromic images on a second group of photosensitive members by deflecting the second group of light beams off the second group of one or more mirrors of the beam deflector toward the second group of photosensitive members to form a second group of latent images on the second group of photosensitive members, the second group of latent images being substantially in phase with the first group of latent images;

developing the first group of latent images by applying thereto a first group of monochromic colored toner to form a first group of monochromatic toner images on the first group of photosensitive members;

developing the second group of latent images by applying thereto a second group of monochromic colored toner to form a second group of monochromatic toner images on the second group of photosensitive members; and transferring the first group of monochromic toner images and the second group of monochromic toner images onto a transfer medium in phase to overlap one another to form the color image on the transfer medium, wherein a distance between a first photosensitive member from the first group of photosensitive members and a second photosensitive member from the second group of photosensitive members, along a sub-scanning direction of the image forming apparatus, corresponds to an odd multiple of half of a distance the transfer medium travels during a pivot period of the beam deflector during which the double mirror portion completes a pivot within a range of its pivoting motion.

18. The method of claim 17, wherein the first and second mirrors are arranged on opposite sides of the double mirror portion such that the deflected phase difference is 180 degrees, and wherein the scanning of the second group of light beams comprises scanning each of the second group of light beams with a timing difference with respect to each of the first group of light beams, the timing difference being an odd multiple of half the pivot period of the beam deflector.

19. The method of claim 18, further comprising positioning the first group of light beams and the second group of light beams such that any one of the first group of light beams being spaced apart from any one of the second group of light beams along a sub-scanning direction by a distance based on a time interval corresponding to an odd multiple of half of the pivot period of the beam deflector and on a travel velocity of the transfer medium.

20. The method of claim 17, wherein the color image is formed by overlapping four different monochromic toner images.

21. The method of claim 20, wherein the first group of monochromic toner images includes two images from among yellow (Y), magenta (M), cyan (C) and black (K) images, and the second group of monochromic toner images includes the remaining two images from among yellow (Y), magenta (M), cyan (C) and black (K) images.

22. A color image forming apparatus, comprising:

a plurality of photosensitive members;

a beam deflector configured to scan light beams on the plurality of photosensitive members to thereby form thereon electrostatic latent images, the beam deflector including a double mirror portion having a first mirror and a second mirror, respective surfaces of which are not coplanar, the double mirror portion being configured to pivot about a pivotal axis that extends substantially parallel to the surfaces of the first and second mirrors such that respective light beams deflected by the first mirror and the second mirror are out of phase with respect to each other by a deflected phase difference; and a transfer member configured to receive from the plurality of photosensitive members a plurality of monochromatic images to overlap one another to thereby form a color image, wherein a first two adjacent ones of the plurality of photosensitive members being spaced apart from each other along a sub-scanning direction of the color image forming apparatus by a first distance, a second two adjacent ones of the plurality of photosensitive members being spaced apart from each other along the sub-scanning direction by a second distance different from the first distance.

23. The color image forming apparatus of claim 22, wherein the first and second mirrors are arranged on opposite sides of the double mirror portion such that the deflected phase difference is 180 degrees, wherein a difference between the first distance and the second distance satisfies:

$$(DP/2)\cdot(2n-1), \text{ and}$$

wherein DP corresponds to the distance the transfer member travels during a pivot period of the beam deflector during which the double mirror portion completes a pivot within a range of its pivoting motion, n being a positive integer greater than zero.

* * * * *

UNITED STATES PATENT AND TRADEMARK OFFICE

CERTIFICATE OF CORRECTION

PATENT NO. : 8,134,584 B2
APPLICATION NO. : 12/558006
DATED : March 13, 2012
INVENTOR(S) : Jong-Chul Choi et al.

It is certified that error appears in the above-identified patent and that said Letters Patent is hereby corrected as shown below:

Column 18, Line 36, In Claim 1, after "portion" insert -- completes a pivot within a --.

Column 19, Line 16, In Claim 8, after "photosensitive" delete "of".

Signed and Sealed this
Twenty-second Day of May, 2012

David J. Kappos

David J. Kappos
*Director of the United States Patent and Trademark Office*